United States Patent [19]

Yokomizo et al.

[11] Patent Number: 5,010,759

[45] Date of Patent: Apr. 30, 1991

[54] WHEEL RIM SHAPING APPARATUS HAVING A SINGLE COTTER SUPPORTABLE AT BOTH ENDS THEREOF

[75] Inventors: Shojiro Yokomizo, Yokohama; Kouji Izumida, Ayase; Takeshi Saito, Yokohama; Yutaka Yanamoto, Ayase, all of Japan

[73] Assignee: Topy Kogyo Kabushiki Kaisha, Tokyo, Japan

[21] Appl. No.: 532,161

[22] Filed: Jun. 5, 1990

Related U.S. Application Data

[63] Continuation of Ser. No. 289,303, Dec. 23, 1988, abandoned.

[30] Foreign Application Priority Data

Dec. 23, 1987 [JP] Japan ..... 62-323857

[51] Int. Cl.[5] ..... B21D 53/30

[52] U.S. Cl. ..... 72/393; 72/353.4; 72/463

[58] Field of Search ..... 72/355, 393, 463; 29/159.1

[56] References Cited

U.S. PATENT DOCUMENTS

| | | | |
|---|---|---|---|
| 887,727 | 5/1908 | Kelly | 72/393 |
| 1,926,400 | 9/1933 | Palmer | 72/393 |
| 3,190,134 | 6/1965 | Sadler et al. | 29/523 |
| 3,382,699 | 5/1968 | Seeman | 72/355 |
| 3,706,120 | 12/1972 | Bulgrin | 72/355 |
| 4,098,108 | 7/1978 | Kozima | 72/327 |
| 4,561,275 | 12/1985 | Itou et al. . | |

FOREIGN PATENT DOCUMENTS

| | | | |
|---|---|---|---|
| 3318516 | 2/1988 | Fed. Rep. of Germany . | |
| 483172 | 9/1975 | U.S.S.R. | 72/393 |

*Primary Examiner*—Lowell A. Larson

*Attorney, Agent, or Firm*—Birch, Stewart, Kolasch & Birch

[57] ABSTRACT

A wheel shaping apparatus including a single cotter for expanding first and second dies circumferentially split into a plurality of first and second die elements, respectively. The single cotter is supported by a cotter supporting member at one end portion of the cotter and is also supported by a cotter guide at the other end portion of the cotter during shaping of a rim element. Because of the single cotter supported at both end portions thereof, rim bead seat portions located at axially end portions of the rim element are shaped in an accurate alignment with each other and almost exactly parallel to each other. In the case when ring-like members are provided around the first and second dies or when teeth are formed at sides of each first and second die element, formation of local deformations at gaps between two adjacent first die elements and between two adjacent second die elements is suppressed.

11 Claims, 7 Drawing Sheets

WHEEL RIM SHAPING APPARATUS HAVING A SINGLE COTTER SUPPORTABLE AT BOTH ENDS THEREOF

This application is a continuation of application Ser. No. 07/289,303, filed on Dec. 23, 1988, now abandoned.

BACKGROUND OF THE INVENTION

1. Field of the Invention

The present invention relates to an apparatus, installed on a vehicle disk wheel manufacturing line, for truing roundness of an annular rim element of a disk wheel. More particularly, the invention relates to an apparatus for truing the rim element such that rim bead seat portions located at axially end portions of the rim element are in alignment with each other and the rim element has no local, radially inwardly deformed portion over its entire circumference.

2. Description of Related Art

A vehicle disk wheel is manufactured in the following way. Firstly, a coiled plate having a predetermined width is developed and is successively cut at a predetermined length to provide flat plates. Each flat plate is conveyed to a coiler which rounds the flat plate. The rounded plate is conveyed to a flush-butt welding station, where both ends of the rounded plate are butt-welded together to provide an annular element. Then, the annular element is conveyed to a flaring station, where axially end portions of the annular element are flared. The flared annular element is then conveyed to a rim contour forming station having a plurality of roll-forming machines arranged in series along the line, where the flared annular element is roll-formed to a rim element having a rough rim contour. The rim element is then conveyed to a shaping apparatus, where the rim element is trued in its roundness by the shaping apparatus. Such a shaping apparatus is often called an expander that usually has a die circumferentially split into a plurality of die elements. The die elements are inserted into the rim element and are spread in the radial direction of the die to radially expand the rim element from the inside thereof. Through the expansion, the shaping apparatus trues the roundness of the rim element. Then, the shaped rim element is conveyed to a disk insertion station, where a disk is inserted into the rim element. Then, the assembly of the rim element and the disk is conveyed to a welding station, where the rim element and the disk are spot-welded together to provide a disk wheel. Finally, the disk wheel is conveyed to a coating station, where the disk wheel is coated.

FIG. 4 illustrates a prior art shaping apparatus and a rim element 62 to be trued in roundness. As is well known, rim element 62 includes a flange portion 62*a*, a rim bead seat portion 62*b*, and a drop portion 62*c*. Rim element 62 is shaped, by a first die circumferentially split into a plurality of first die elements 64 and a second die circumferentially split into a plurality of second die elements 66, to a more exactly true circle. Two cotters 68 and 70 are provided. Cotters 68 and 70 include tapered portions 72 and 74, respectively. As shown in FIG. 5, one cotter 68 is inserted into the first die and the other cotter 70 is inserted into the second die, and first and second die elements 64 and 66 are pushed radially outwardly by tapered portions 72 and 74 of first and second cotters 68 and 70 via circumferentially split segments 78 and 80, respectively. A left half portion of FIG. 6 illustrates an expansion state of die elements 64 and 66, while a right half portion of FIG. 6 illustrates a shrinkage state of die elements 64 and 66. When die elements 64 and 66 are radially outwardly pushed, rim element 62 is radially expanded and shaped. As shown in FIG. 7, when a split type die is used, the shaped rim element 62 will include a plurality of local, radially inwardly deformed portions 62*p* which are naturally formed due to clearances 76 between the die elements.

However, the prior art shaping apparatus has the following problems.

(a) Because the two cotters 68 and 70 are used and each cotter is constructed in the form of a cantilever, cotters 68 and 70 tend to be inclined and to come out of alignment with respect to each other when different transverse forces act on cotters 68 and 70. Such inclination and misalignment are illustrated in FIG. 8. The rim element which has been shaped under such inclination and misalignment of cotters 68 and 70 will be distorted as shown in FIG. 9. As a result, as shown in FIG. 10, when a disk 82 is inserted into the distorted rim element 62 at the successive disk insertion station, it will be difficult to smoothly insert disk 82 into rim element 62. Thus, a further distortion may happen in rim element 62 and disk 82, because an axis 84 of rim element 62 is inclined with respect to an axis 86 of disk 82.

(b) When such inclination and misalignment of cotters 68 and 70 happen, rim bead seat portions 62*b* and 62*b* located at the end portions of rim element 62 will be formed out of alignment with each other as shown in FIG. 11 which illustrates, in a developed state, the radial deflections A1′ and A2′ of the rim bead seat portions from a true circle. This causes a considerably severe transverse vibration of a vehicle when the disk wheel is mounted to the vehicle and is rotated.

(c) The local, radially inwardly deformed portions 62*p* formed in rim bead seat portions 62*b* of rim element 62 cause a vertical vibration of a vehicle when the disk wheel is mounted to the vehicle and is rotated. Further, radially inwardly deformed portions 62*p* formed in drop portion 62*c* of rim element 62 make it further difficult to insert disk 82 into rim element 62.

SUMMARY OF THE INVENTION

An object of the present invention is to provide a wheel rim shaping apparatus for truing roundness of a rim element such that the rim bead portions located at axially end portions of the rim element are in alignment with each other.

Another object of the present invention is to provide a wheel rim shaping apparatus for shaping a rim element such that the shaped rim element has almost no local, radially inwardly deformed portion over the entire circumference thereof.

The above-described object can be attained by a wheel rim shaping apparatus in accordance with the present invention. The apparatus generally includes a first die, a second die, a first die holder, a second die holder, a single cotter, a first die holder supporting member, a second die holder supporting member, a cotter supporting member for supporting the cotter at one end portion of the cotter, and a cotter guide, engageable with the cotter at the other end portion of the cotter, for also supporting the cotter at the other end portion of the cotter.

More particularly, the first die is split into a plurality of first die elements in a circumferential direction of the first die so that the first die can spread and shrink in a radial direction of the first die. The second die is provided coaxially with the first die so as to be movable relative to the first die in an axial direction of the first die. The second die is split into a plurality of second die elements in a circumferential direction of the second die so that the second die can spread and shrink in a radial direction of the second die. The first die holder is split into a plurality of first die holder elements in a circumferential direction of the first die holder. Each of the first die holder elements is movable in a radial direction of the first die holder and engages the first die so as to spread and shrink the first die. The second die holder is split into a plurality of second die holder elements in a circumferential direction of the second die holder. Each of the second die holder elements is movable in a radial direction of the second die holder and engages the second die so as to spread and shrink the second die. The cotter is provided coaxially with the first and the second dies and is movable in a longitudinal, axial direction of the cotter. The cotter is capable of extending through the second die holder into the first die holder to engage both first and second die holders when the cotter is moved in a direction toward the first die. The first die holder supporting member is secured to a fixed member of a press apparatus. The first die holder supporting member supports the first die holder such that each of the first die holder elements is slidable relative to the first die holder supporting member in the radial direction of the first die holder. The second die holder supporting member is provided on one side of the first die holder supporting member and is movable relative to the first die holder supporting member in an axial direction of the first die holder supporting member. The second die holder supporting member supports the second die holder such that each of the second die holder elements is slidable relative to the second die holder supporting member in the radial direction of the second die holder. The cotter supporting member is provided on the same side of the first die holder supporting member as the second die holder supporting member and is provided further from the first die holder supporting member than the second die holder supporting member. The cotter supporting member is movable relative to the first die holder supporting member and the second die holder supporting member in the axial direction of the first die holder supporting member. The cotter supporting member is fixed to a movable member of the press apparatus. The cotter supporting member fixedly supports the cotter at the one end portion of the cotter. The cotter guide is supported so as to be fixed in position with respect to the first die holder supporting member. The cotter guide is capable of slidably engaging the cotter at the other end portion of the cotter when the cotter is moved in the direction toward the first die holder supporting member.

Further, it is preferable that ring-like members are provided around the first and second die holders, or that the first and second die elements have toothed sides for slidably engaging toothed sides of adjacent first and second die holder elements, respectively.

When a rim element is shaped by the above-described apparatus, because the shaping apparatus has the single cotter and the single cotter is supported at both end portions thereof while the rim element is shaped, no misalignment between the rim bead seat portions axially separated from each other is caused. Further, when the ring-like members or the toothed sides are provided to the dies, almost no local deformation is caused in the rim element over the entire circumference of the rim element.

BRIEF DESCRIPTION OF THE DRAWINGS

These and other objects and advantages of the present invention will become more apparent and more readily appreciated from the following detailed description of the presently preferred embodiment of the invention taken in conjunction with the accompanying drawings, in which.

DETAILED DESCRIPTION OF THE PREFERRED EMBODIMENTS

A wheel rim shaping apparatus of the present invention may have a vertical orientation wherein a cotter extends in a vertical direction or a lateral orientation wherein a cotter extends in a horizontal direction. Hereinafter, the explanation will refer to the vertical orientation as an example.

Figure 1:
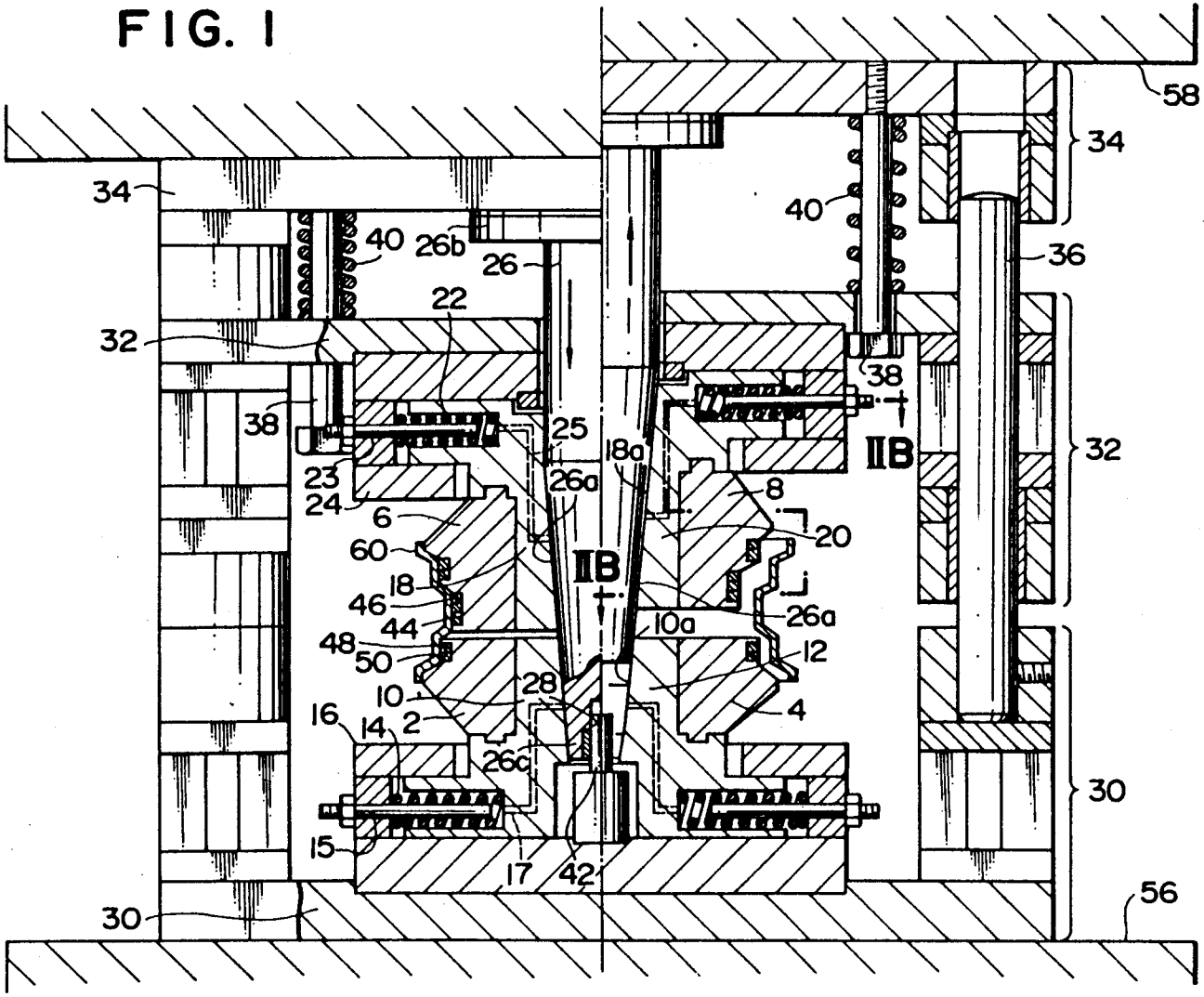
FIG. 1 is a cross-sectional view of a wheel shaping apparatus in accordance with one embodiment of the present invention.

The positioning of the apparatus before shaping of a rim element is shown in a right half portion of FIG. 1 and the positioning during the shaping is shown in a left half portion of FIG. 1. As shown in FIG. 1, the wheel rim shaping apparatus is mounted between a fixed member 56 and a movable member 58 of a press apparatus. Movable member 58 is movable relative to fixed member 56.

The wheel rim shaping apparatus of the present invention generally includes a first die 2, a second die 6, a first die holder 10, a second die holder 18, a single cotter 26, a first die holder supporting member 30, a second die holder supporting member 32, a cotter supporting member 34 for supporting cotter 26 at one end portion **26*b* of cotter 26, and a cotter guide 42**, engageable with cotter 26, for supporting cotter 26 at the other end portion 26c of cotter 26.

More particularly, first die 2 is split into a plurality of first die elements 4 in a circumferential direction of first die 2 so that first die 2 can spread and shrink in a radial direction of first die 2. Second die 6 is provided coaxially with first die 2 so as to be movable relative to first die 2 in an axial direction of first die 2. Second die 6 is split into a plurality of second die elements 8 in a circumferential direction of second die 6 so that second die 6 can spread and shrink in a radial direction of second die 6. First die holder 10 is split into a plurality of first die holder elements 12 in a circumferential direction of first die holder 10. Each of first die holder elements 12 is movable in a radial direction of first die holder 10 and radially engages first die 2 so as to spread and shrink first die 2. Second die holder 18 is split into a plurality of second die holder elements 20 in a circumferential direction of second die holder 18. Each of second die holder elements 20 is movable in a radial direction of second die holder 18 and radially engages second die 6 so as to spread and shrink second die 6.

Cotter 26 is provided coaxially with first and second dies 2 and 6 and is movable in a longitudinal, axial direction of cotter 26. Cotter 26 is capable of extending through second die holder 18 into first die holder 10 to engage both first and second die holders 10 and 18 from inside thereof when cotter 26 is moved in the direction toward first die holder 10, that is, toward first die holder supporting member 30.

First die holder supporting member 30 is secured to fixed member 56 of the press apparatus. First die holder supporting member 30 supports first die holder 10 such that each of first die holder elements 12 is slidable relative to first die holder supporting member 30 in the radial direction of first die holder 10. Second die holder supporting member 32 is provided on one side of first die holder supporting member 30 and is movable relative to first die holder supporting member 30 in the axial direction of first die holder supporting member 30. Second die holder supporting member 32 supports second die holder 18 such that each of second die holder elements 20 is slidable relative to second die holder supporting member 32 in the radial direction of second holder 18. Cotter supporting member 34 is provided on the same side of first die holder supporting member 30 as second die holder supporting member 32 and is provided further from first die holder supporting member 30 than second die holder supporting member 32. Cotter supporting member 34 is movable relative to first die holder supporting member 30 and second die holder supporting member 32 in the axial direction of first die holder supporting member 30. Cotter supporting member 34 is fixed to movable member 58 of the press apparatus. Cotter supporting member 34 is secured to and supports cotter 26 at the one end portion 26b of cotter 26.

Cotter guide 42 is supported so as to be fixed in position with respect to first die holder supporting member 30. More particularly, cotter guide 42 is fixedly supported by either one of first die holder supporting member 30 and a member fixed to first die holder supporting member 30. Cotter guide 42 is capable of slidably engaging cotter 26 at the other end portion 26c of cotter 26 when cotter 26 is moved in the direction toward first die holder supporting member 30.

The wheel rim shaping apparatus further includes a guide post 36, a first die holder support 16, a second die holder support 24, a first spring 14, a second spring 22, a support bolt 38, and an urging spring 40.

More particularly, guide post 36 extends between first die holder supporting member 30 and cotter supporting member 34 and slidably extends through second die holder supporting member 32 so that second die holder supporting member 32 is aligned with first die holder supporting member 30 and cotter supporting member 34.

First die holder support 16 is fixed to first die holder supporting member 30 and slidably holds first die holder 10 between first die holder support 16 and first die holder supporting member 30. In the embodiment, cotter guide 42 is fixed to first die holder support 16. Second die holder support 24 is fixed to second die holder supporting member 32 and slidably holds second die holder 18 between second die holder support 24 and second die holder supporting member 32. First spring 14 is provided between first die holder support 16 and first die holder 10 so as to urge each of first die holder elements 12 in a radially inward direction of first die holder 10. Second spring 22 is provided between second die holder support 24 and second die holder 18 so as to urge each of second die holder elements 20 in a radially inward direction of second die holder 18.

Support bolt 38 is coupled to cotter supporting member 34. Support bolt 38 extends through second die holder supporting member 32 and engages second die holder supporting member 32. Urging spring 40 is provided between cotter supporting member 34 and second die holder supporting member 32 so as to urge second die holder supporting member 32 relative to cotter supporting member 34 in the direction toward first die holder supporting member 30.

The engagement structures between cotter 26 and first die holder 10, between cotter 26 and second die holder 18, and between cotter 26 and cotter guide 42 will be explained hereinafter. Cotter 26 includes a tapered portion 26a that is decreased in diameter in the direction toward first die holder supporting member 30. First and second die holders 10 and 18 include tapered portions 10a and 18a, respectively, that are decreased in diameter in the direction toward first die holder supporting member 30. Tapered portion 26a of cotter 26 comes into contact with tapered portions 18a of second die holder 18 and tapered portion 10a of first die holder 10 when cotter 26 is moved toward first die holder supporting member 30. Hollow shafts 15 and 23 function as spring guides for first and second springs 14 and 22, respectively, and extend through first and second die holder supports 16 and 24, respectively, so as to pass a lubricating oil therethrough. The lubricating oil is communicated via oil paths 17 and 25 formed in first and second die holders 10 and 18 to the sliding surfaces between first die holder 10 and cotter 26 and between second die holder 18 and cotter 26, respectively. Cotter 26 has an axially extending and axially opening hole 28 formed in an end portion 26c of cotter 26 close to cotter guide 42. Cotter guide 42 comprises an axially extending pin in alignment with cotter 26 that slidably engages hole 28 of cotter 26 when cotter 26 is moved in the direction toward first die holder supporting member 30.

Figure 2A:
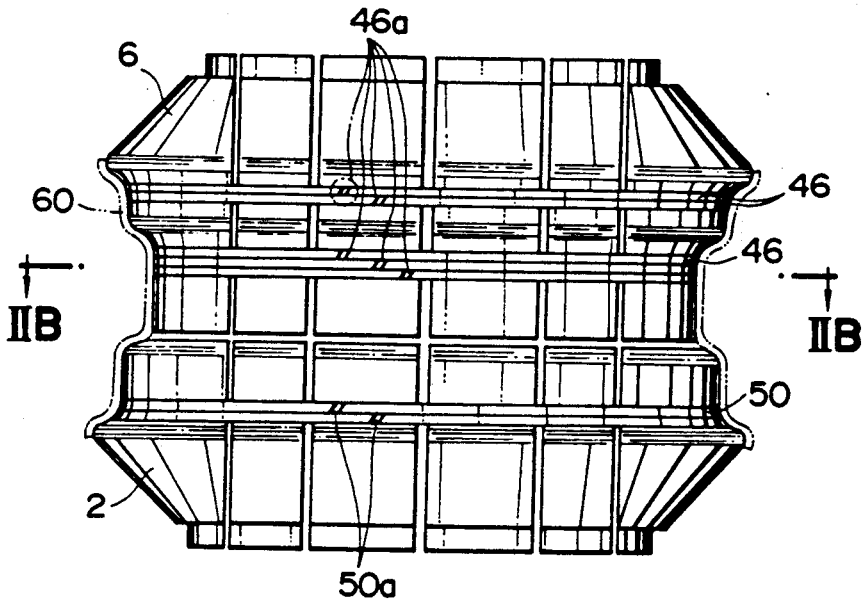
FIG. 2A is an enlarged elevational view of first and second dies installed in the apparatus of FIG. 1.
Figure 2B:
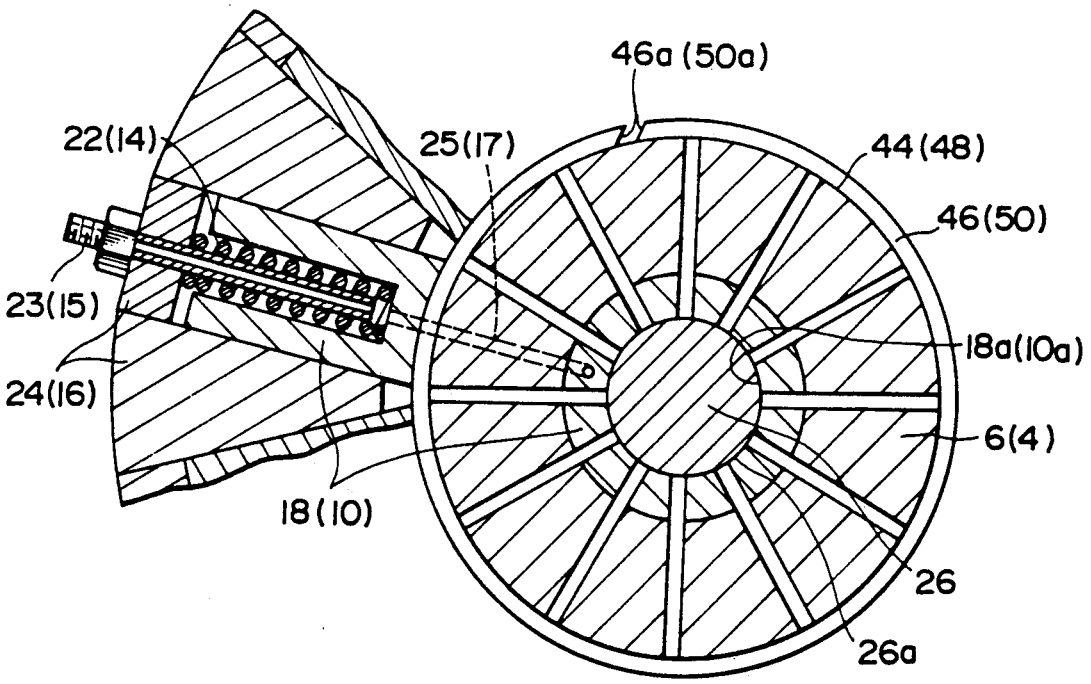
FIG. 2B is a cross-sectional view of members including the first and second dies and first and second die holders taken along line IIB—IIB of FIG. 1.

The structures for preventing local deformation of rim element 60 will be explained in reference with FIGS. 2A, 2B, 3A, and 3B. As shown in FIGS. 2A and 2B, second die 6 has at least one groove 44 that is formed in a radially outer portion of second die 6 and extends over an entire circumference of second die 6.

At least one ring-like member 46 having a cut portion 46*a* on its circumference is fitted in each groove 44. Preferably, a plurality of the grooves 44 and a plurality of the ring-like members 46 are provided. Cut portions 46*a* of ring-like members 46 are staggered from each other in the circumferential direction of second die 6. Similarly, first die 2 has at least one groove 48 that is formed in a radially outer portion of first die 2 and extends over an entire circumference of first die 2. At least one ring-like member 50 having a cut portion 50*a* on its circumference is positioned in each groove 48. Preferably, a plurality of grooves 48 and a plurality of the ring-like members 50 are provided, and cut portions 50*a* of ring-like members 50 are staggered from each other in the circumferential direction of first die 2.

Figure 3A:
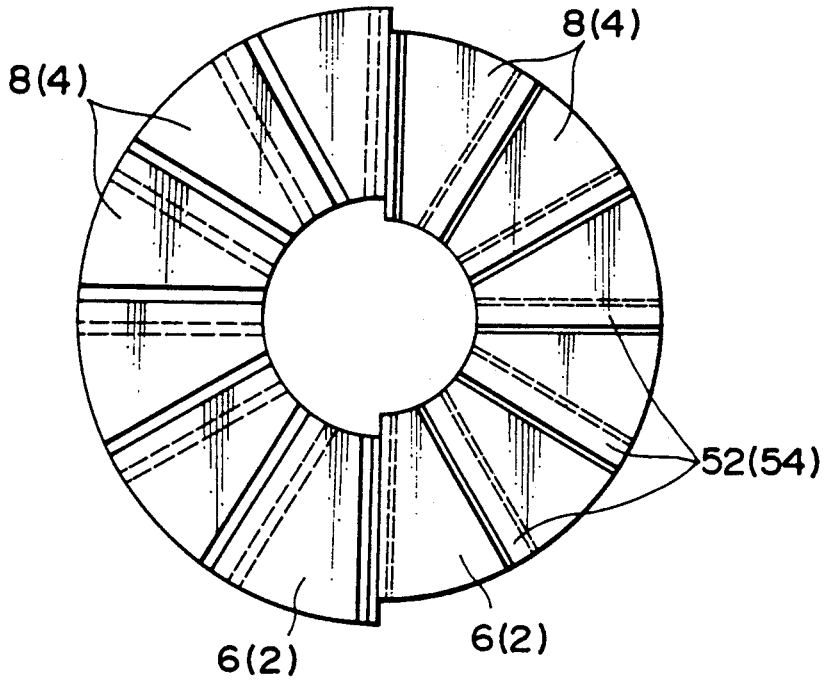
FIG. 3A is an enlarged plan view of first and second dies in accordance with another embodiment of the present invention.
Figure 3B:
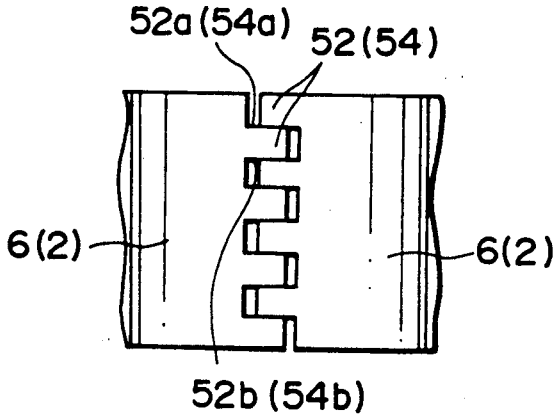
FIG. 3B is a partial elevational view of the first and second dies of FIG. 3A.
Figure 4:
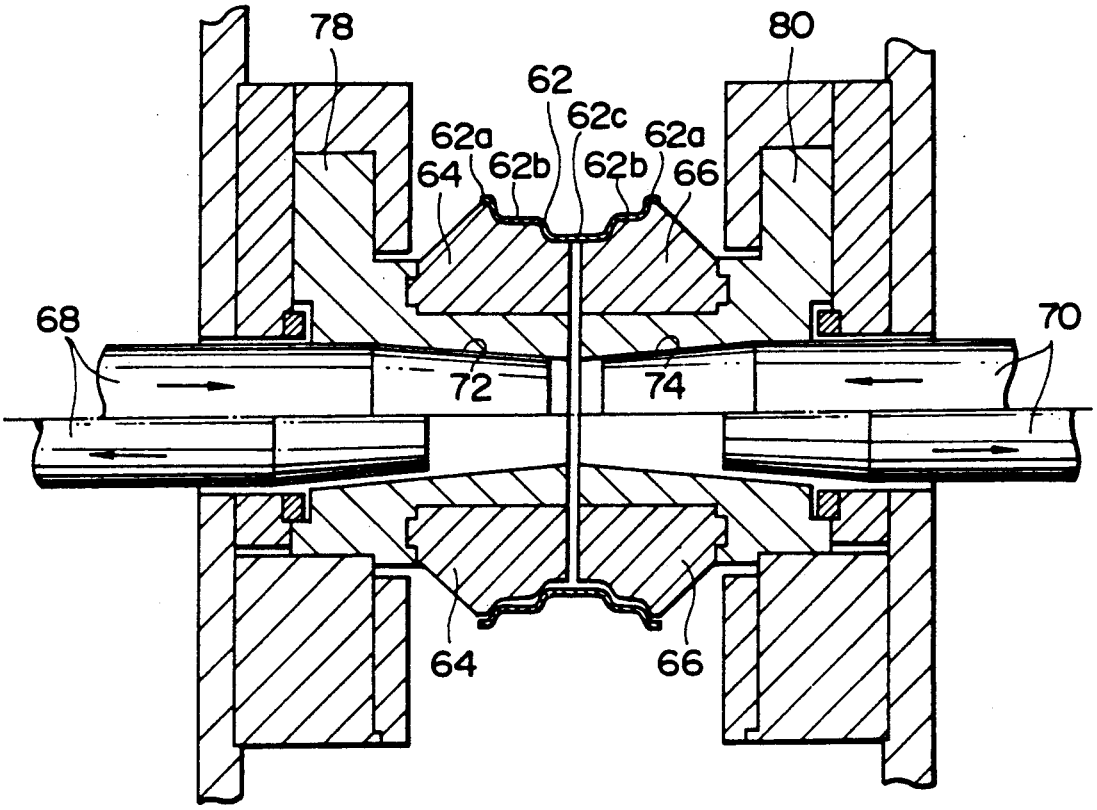
FIG. 4 PRIOR ART
FIG. 4 is a cross-sectional view of a prior art wheel shaping apparatus including a split-type die.
Figure 5:
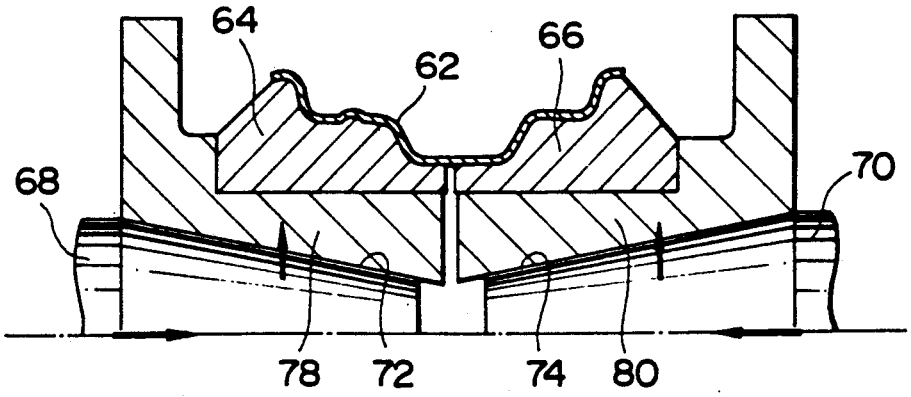
FIG. 5 PRIOR ART
FIG. 5 is a partial cross-sectional view of die elements of the die of the apparatus of FIG. 4.
Figure 6:
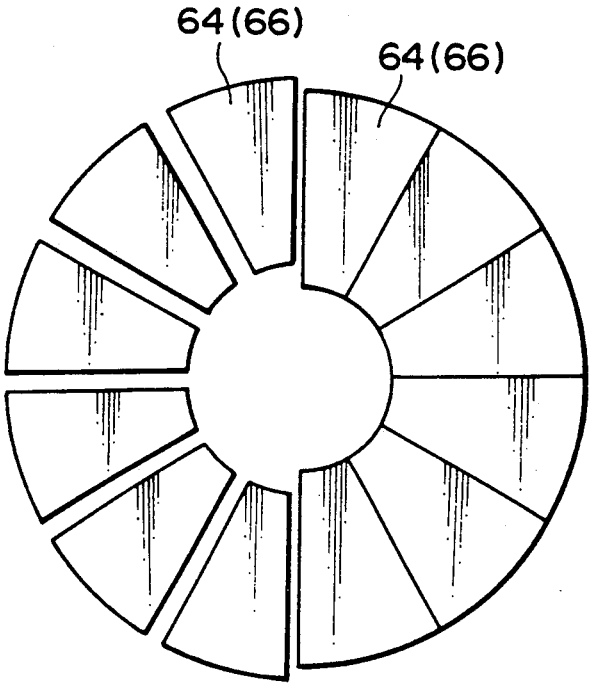
FIG. 6 PRIOR ART
FIG. 6 is a plan view of the die elements of FIG. 5 illustrating expansion and shrinkage states of the die of FIG. 4.
Figure 7:
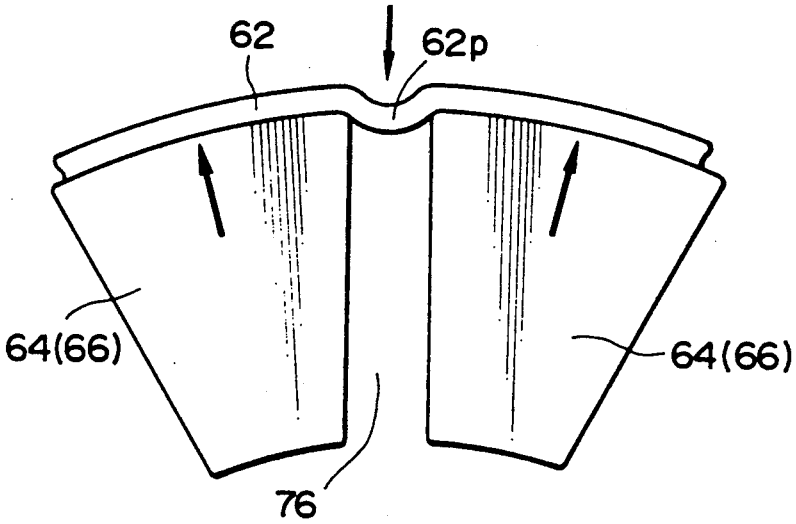
FIG. 7 PRIOR ART
FIG. 7 is a partial plan view of the die elements of FIG. 5 and a rim element illustrating a local, deformed portion formed in the rim element.
Figure 8:
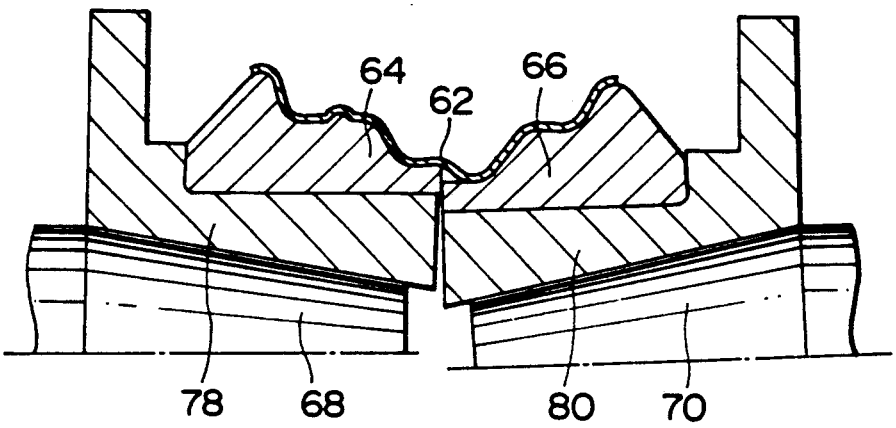
FIG. 8 PRIOR ART
FIG. 8 is a partial cross-sectional view of the dies of FIG. 4 illustrating inclinations of cotters and misalignment between the dies.
Figure 9:
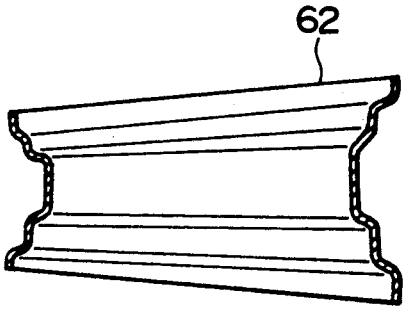
FIG. 9 PRIOR ART
FIG. 9 is an elevational view of a distorted rim element shaped using the prior art shaping apparatus.
Figure 10:
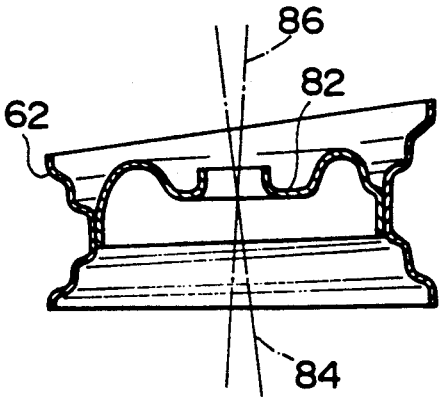
FIG. 10 PRIOR ART
FIG. 10 is a cross-sectional view of the distorted rim element of FIG. 9 and a disk inserted into the rim element.

The combination of the groove and the ring-like member may be substituted by the following toothed side structure. As shown in FIGS. 3A and 3B, each of second die elements 8 has teeth 52 on its side surfaces which slidably engage teeth of an adjacent second die element. Each tooth 52 has first and second surfaces 52*a* and 52*b*, opposite to each other, which are parallel to each other and perpendicular to the axis of second die 6 so as not to limit interference between two adjacent second die elements 8. Similarly, each of first die elements 4 has teeth 54 on its side surfaces that slidably engage teeth of an adjacent first die element. Each tooth 54 has first and second surfaces 54*a* and 54*b*, opposite to each other, that are parallel to each other and perpendicular to the axis of first die 2 so as not to limit interference between two adjacent first die elements 4.

Next, the shaping of a wheel rim using the above-described wheel rim shaping apparatus will be explained. When movable member 58 of the press apparatus is moved to a position displaced from fixed member 56 of the press apparatus, cotter supporting member 34, cotter 26, second die holder supporting member 32, second die holder 18 and second die 6 are moved to a position displaced from fixed member 56 of the press apparatus. Thereafter, a rim element 60 to be shaped is brought to and is mounted on first die 2.

Then, movable member 58 of the press apparatus is moved in the direction toward fixed member 56 of the press apparatus by operating a cylinder (not shown) of the press apparatus to move cotter supporting member 34 and cotter 26 as well as to move second die holder supporting member 32, second die holder 18 and second die 6 in the same direction. When these members are moved, end portion 26*c* of cotter 26 is firstly brought into slidable engagement with cotter guide 42 so that cotter 26 is supported at both end portions thereof.

When further moved, tapered portion 26*a* of cotter 26 is then brought into contact with tapered portion 18*a* of second die holder 18 and tapered portion 10*a* of first die holder 10 so that first and second die holders 10 and 18 are expanded radially outwardly. When each of second die holder elements 20 and each of first die holder elements 12 are pushed radially outwardly, each of second die elements 8 and each of first die elements 4 are pushed radially outwardly so that second die 6 and first die 2 are expanded to true the roundness of rim element 60.

After the shaping of rim element 60, movable member 58 of the press apparatus is moved in a reverse direction to the original position. When cotter 26 is moved in the reverse direction and disengages first and second die holders 10 and 18, each of first die holder elements 12 and each of second die holder elements 20 are moved radially inwardly by first and second springs 14 and 22, respectively, so that first and second dies 2 and 6 shrink radially and disengage the shaped rim element 60. Then, the shaped rim element 60 is taken away from first die 2.

In the above-described shaping of rim element 60, it is to be noted that only one cotter 26 is used and cotter 26 is supported at both end portions 60*b* and 60*c* during the shaping of rim element 60. Thus, misalignment between cotters that tends to happen in the prior art shaping apparatus having two cotters does not happen in the shaping apparatus of the present invention including the single cotter 26. In addition, the inclination of a cotter that happens with regard to the cantilever-type cotter of the prior art does not take place with respect to cotter 26 of the present invention supportable at both end portions 26*b* and 26*c* thereof. Because of the structure of the cotter 26, an alignment between first and second dies 2 and 6 is maintained with a high accuracy so that rim bead seat portions located at the axially end portions of rim element 60 can be shaped in a correct alignment with each other and shaped to be almost exactly parallel to each other.

Figure 11:
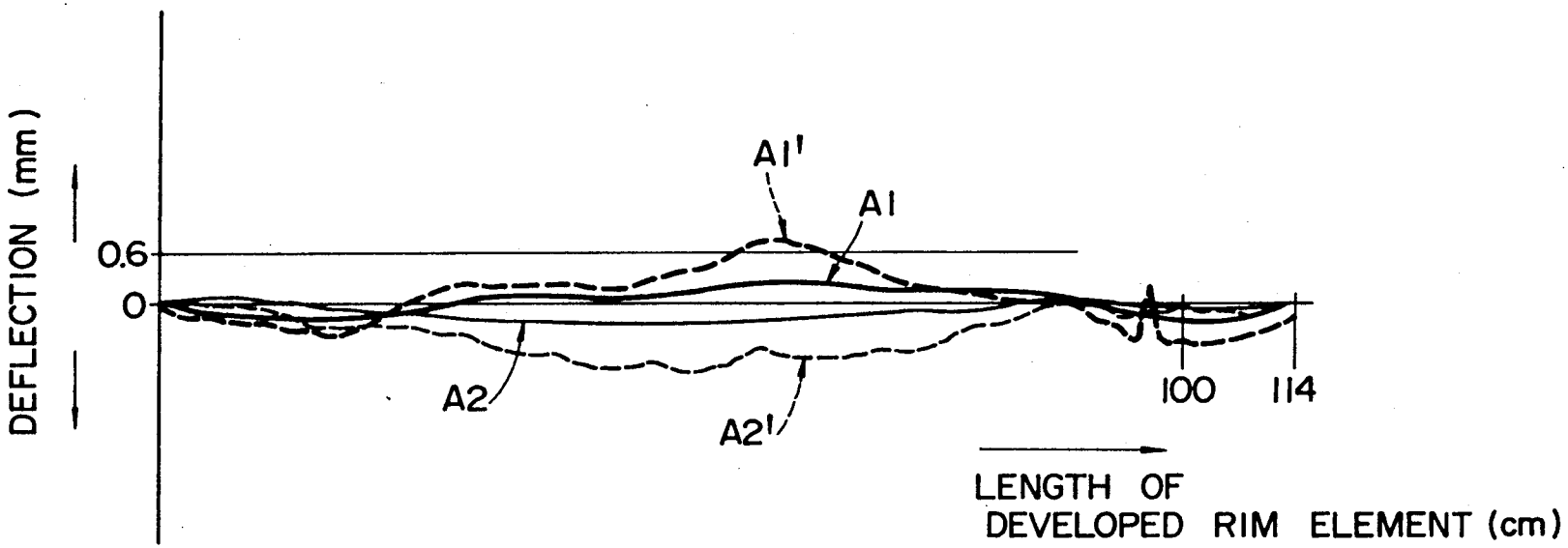
FIG. 11 is a graph illustrating, in a developed state, deflections of rim bead seat portions of the distorted rim element of FIG. 9 from a true circle.

Shaping tests were performed using rim elements each having a diameter of 36.4 cm and a width of 14.3 cm and using the apparatus of the present invention and the apparatus of the prior art. FIG. 11 illustrates the test results, wherein characters A1′ and A2′ illustrate radial or axial deflections at one rim bead seat portion and at the other rim end portion, respectively, obtained in the test using the prior art apparatus. Characters A1 and A2 illustrate radial or axial deflections at one rim bead seat portion and at the other rim bead seat portion, respectively, obtained in the test using the apparatus of the present invention. As shown in FIG. 11, an average radial deflection of 0.6 mm from a true circle and an average axial deflection of 0.6 mm from a plane perpendicular to the axis of the rim element were observed at each end portion of the rim element in the results of the test using the prior art apparatus, while an average radial deflection less than 0.2 mm from a true circle and an average axial deflection less than 0.2 mm from a plane perpendicular to the axis of the rim element were observed at respective end portions of rim element 60 in the results of the test using the apparatus of the present invention.

Further, it is to be noted that, in the present invention, clearances or gaps between the two adjacent second die elements 8 and between the two adjacent first die elements 4 are covered by ring-like members 46 and 50 in the embodiment of FIGS. 2A and 2B, and by teeth 52 and 54 in the embodiment of FIGS. 3A and 3B. Therefore, no local, radially inwardly deformed portions are formed in the shaped rim element 60, because ring-like members 46 and 50 and teeth 52 and 54 prevent rim element 60 from being deformed radially inwardly at the clearances between first and second die elements 4 and 8. The prevention of local deformations is obtained not only at the rim bead seat portions but also at the drop portion of rim element 60.

Shaping tests were performed using rim elements each having a diameter of 36.4 cm and a width of 14.3 cm and using the prior art apparatus and the apparatus of the present invention. Local radial deformations larger than 0.2 mm were seen in the shaped rim element shaped by the prior apparatus, while local radial deformations less than 0.1 mm were only seen in the shaped rim element shaped by the apparatus of the present invention.

As will be apparent from the above description, the following effects are obtained according to the present invention.

Because of the single cotter 26 which is supported at both end portions thereof during the shaping of rim element 60, the rim bead seat portions located at the end portions of rim element 60 can be shaped in an accurate alignment with each other and almost exactly parallel to each other. This exact shaping greatly suppresses vertical and lateral vibrations of a vehicle when the disk wheel is mounted to the vehicle and is rotated. Also, this exact shaping makes it easy to insert a disk into the rim element at the disk insertion station of the disk wheel manufacturing line. In order to obtain these effects, it is essential to support cotter 26 not only at one end portion **26*b* of cotter by means of cotter supporting member 34 but also at the other end portion 26*c* of cotter 26 by means of cotter guide 42 during the shaping of rim element 60**.

In the case that ring-like members 46 and 50 or toothed sides formed by teeth 52 and 54 are provided, formation of a local deformation in rim element 60 is greatly suppressed. This further improves vertical vibration of the vehicle when the disk wheel is mounted to the vehicle and is rotated.

Although only a few preferred embodiments of the present invention have been described in detail above, it will be appreciated by those skilled in the art that many modifications and alterations are possible without departing from the novel teachings and advantages of the invention. Accordingly, all such modifications and alterations are intended to be included within the spirit and scope of the present invention as defined in the following claims.

What is claimed is:

1. A wheel rim shaping apparatus to be mounted between a fixed member and a movable member of a press apparatus, comprising:

a first die split into a plurality of first die elements in a circumferential direction of the first die so that the first die can expand and contract in a radial direction of the first die;

a second die provided coaxially with the first die so as to be movable relative to the first die in an axial direction of the first die, the second die being split into a plurality of second die elements in a circumferential direction of the second die so that the second die can expand and contact in a radial direction of the second die;

a first die holder split into a plurality of first die holder elements in a circumferential direction of the first die holder, a first spring means urging each of the first die holder elements in a radially inward direction of the first die holder for constant engagement with said cotter, said first die holder elements engaging the first die so as to expand and contract the first die;

a second die holder split into a plurality of second die holder elements in a circumferential direction of the second die holder, a second spring means urging each of the second die holder elements in a radially inward direction of the second die holder for constant engagement with said cotter, said second die holder elements engaging the second die so as to expand and contract the second die;

a single cotter having a central axis is provided coaxially with the first and second dies and movable in an axial direction of the cotter, the cotter having a bushing with an axially extending and axially open hole having a central axis coaxial with said central axis of the cotter is located in a lower end portion of the cotter, said axially open hole having a continuous circumferential inner surface, the cotter being capable of extending through the second die holder into the first die holder to engage the first and second die holders when the cotter is moved in a direction toward the first die holder supporting member;

a first die holder supporting member secured to a fixed member of a press apparatus, the first die holder supporting member supporting the first die holder for slidably mounting each of the first die holder elements relative to the first die holder supporting member in the radial direction of the first die holder;

a second die holder supporting member provided on one side of the first die holder supporting member and movable relative to the first die holder supporting member, in an axial direction of the first die holder supporting member, the second die holder supporting member supporting the second die holder for slidably mounting each of the second die holder elements relative to the second die holder supporting member in the radial direction of the second die holder;

a cotter supporting member provided on the same side of the first die holder supporting member as the second die holder supporting member and provided further from the first die holder supporting member than the second die holder supporting member, the cotter supporting member being movable relative to the first die holder supporting member and the second die holder supporting member in the axial direction of the first die holder supporting member, the cotter supporting member being secured to a movable member of the press apparatus, the cotter supporting member securely supporting the cotter at one end portion of the cotter;

oil path means located in said first die holder and in said second die holder for providing lubricating oil to sliding surfaces between said first die holder and said cotter and between said second die holder and said cotter respectively; and means for guiding said cotter including a cotter guide fixedly supported so as to be fixed in a position with respect to the first die holder supporting member, the cotter guide having an upwardly extending pin fixed thereto and having a central axis in alignment with said center axis of the cotter, the cotter guide being capable of slidably engaging the cotter at said continuous circumferential inner surface of said axially open hole of the cotter when the cotter is moved in the direction toward the first die holder supporting member.

2. The wheel rim shaping apparatus according to claim 1, further comprising a guide post extending between the first die holder supporting member and the cotter supporting member and slidably extends through the second die holder supporting member so that the second die holder supporting member is aligned with the first die holder supporting member and the cotter supporting member.

3. The wheel rim shaping apparatus according to claim 1, further comprising:

a first die holder support fixed to the first die holder supporting member and slidably mounting the first die holder between the first die holder support and the first die holder supporting member; and a second die holder support fixed to the second die holder supporting member and slidably mounting the second die holder between the second die holder support and the second die holder supporting member.

4. The wheel rim shaping apparatus according to claim 1, further comprising:

a support bolt, fixed to the cotter supporting member and extending in the direction toward the first die holder supporting member, for supporting the second die holder supporting member; and an urging spring provided between the cotter supporting member and the second die holder supporting member so as to urge the second die holder supporting member in the direction toward the first die holder supporting member.

5. The wheel rim shaping apparatus according to claim 1, wherein the cotter includes a tapered portion decreased in diameter in the direction toward the first die holder supporting member, and each of the first and second die holders includes a tapered portion decreased in diameter in the direction toward the first die holder supporting member, the tapered portion of the cotter coming into contact with the tapered portion of the first die holder and the tapered portion of the second die holder when the cotter is moved in the direction toward the first die holder supporting member.

6. The wheel rim shaping apparatus according to claim 1, wherein the first die has at least one groove formed at a radially outer portion of the first die and extending over an entire circumference of the first die, and at least one ring-like member having a cut portion on its circumference is fitted in each groove.

7. The wheel rim shaping apparatus according to claim 6, wherein a plurality of the grooves and a plurality of the ring-like members are provided, and the cut portions of the ring-like members are staggered from each other in the circumferential direction of the first die.

8. The wheel rim shaping apparatus according to claim 1, wherein the second die has at least one groove formed at a radially outer portion of the second die and extending over an entire circumference of the second die, and at least one ring-like member having a cut portion on its circumference is fitted in each groove.

9. The wheel rim shaping apparatus according to claim 8, wherein a plurality of the grooves and a plurality of the ring-like members are provided, and the cut portions of the ring-like members are staggered from each other in the circumferential direction of the second die.

10. The wheel rim shaping apparatus according to claim 1, wherein each of the first die elements includes teeth on its side surfaces for slidably engaging teeth on an adjacent first die element.

11. The wheel rim shaping apparatus according to claim 1, wherein each of the second die elements includes teeth on its side surfaces for slidably engaging teeth on an adjacent second die element.

* * * * *